United States Patent [19]

Smit

[11] 4,274,750

[45] Jun. 23, 1981

[54] GRAIN STIRRER DRIVE ASSEMBLY

[75] Inventor: Edward H. Smit, Sheffield, Iowa

[73] Assignee: Sukup Manufacturing Co., Sheffield, Iowa

[21] Appl. No.: 940,436

[22] Filed: Sep. 7, 1978

[51] Int. Cl.[3] ..... B01F 7/24

[52] U.S. Cl. ..... 366/261; 74/812

[58] Field of Search ..... 366/241, 287, 281, 318, 366/282, 283, 284, 261; 74/812, 380, 465 L

[56] References Cited

U.S. PATENT DOCUMENTS

| | | | |
|---|---|---|---|
| Re. 27,931 | 2/1974 | Sukup | 366/241 |
| 2,351,012 | 6/1944 | Carpenter | 74/812 |
| 3,156,541 | 11/1964 | Kalke | 366/241 |
| 3,198,493 | 8/1965 | Sukup | 366/241 |
| 3,251,582 | 5/1966 | Murphy | 366/241 |
| 3,272,480 | 9/1966 | Sukup | 366/241 |
| 3,448,966 | 6/1969 | Sukup | 366/241 |
| 3,580,549 | 5/1971 | Murphy | 366/241 |
| 3,584,842 | 6/1971 | Sukup | 366/241 |
| 3,776,512 | 12/1973 | McKinnon | 366/241 |

OTHER PUBLICATIONS

Brochure Entitled "Sukup Stirway".

*Primary Examiner*—Robert W. Jenkins

*Attorney, Agent, or Firm*—Neuman, Williams, Anderson & Olson

[57] ABSTRACT

An improved drive arrrangement in grain stirrers of the type including a sweep arm suspended between a track along the bin sidewall and a pivot support toward the bin's center. The sweep arm includes a laterally extending support element extending from the support frame, being selectively rotatable or counterrotatable, and a sweep drive unit being selectively rotatable independently of the support element and including a drive wheel engaging the bin track. Stirring augers depend from the laterally extending sweep arm, and are adapted for radial movement along the sweep arm in either direction in accordance with rotation and counter-rotation of the support element. An automatically selective reversing drive system, comprising opposed one-way clutches, interconnects the support element and the drive wheel whereby the sweep arm is driven in one direction around the bin in response to both such rotation and such counterrotation of the support element.

8 Claims, 4 Drawing Figures

GRAIN STIRRER DRIVE ASSEMBLY

BACKGROUND OF THE INVENTION

This invention relates to stirring assemblies of the type used in grain bins, such as are disclosed in said copending application Ser. No. 877,951 of Eugene G. Sukup, and more particularly to drive assemblies of the type employed to move a sweep arm and one or more stirring augers carried thereon around a grain bin. Specifically, this invention relates to the species of drive system illustrated in FIGS. 8 and 9 of the aforementioned application, and was made by me subsequent to the development by Eugene G. Sukup of the apparatus illustrated in FIGS. 1-5 of said application.

In modern grain storage systems, it has been found that the movement and stirring of grain within a bin facilitates drying and storage thereof without spoilage. Grain stirring typically is accomplished by one or more augers suspended on a sweep arm which sweeps around the bin. To maximize stirring effectiveness, it is desirable to alter the stirring paths of one or more such augers during each sweep around the bin. In so doing, stirring of substantially all of the grain in the bin may be accomplished in a minimum number of sweeps. To achieve such grain stirring in the shortest amount of time, it is desirable that the sweep arm and, hence, the stirring augers be in continuous sweep movement around the bin, while certain of the stirring augers move radially along the arm. A prevalent mode of altering the stirring paths is to move one or more of the stirring augers radially inwardly and outwardly along the sweep arm by rotating or counterrotating the arm. To achieve such movement of the stirring augers radially of the sweep arm, while at the same time continually moving the sweep arm around the bin in the same direction, the rotation of the sweep arm must be independent of the advancing drive force which effects sweep arm movement around the bin.

As disclosed in FIGS. 1-3 of the aforementioned application Ser. No. 877,951, continual travel of the sweep arm around the grain bin while permitting independent rotation thereof may be accomplished by using a separate motor for each function. As an alternative, a single motor and reversal drive mechanism at the center, with a drive rod extending through the outer sleeve also will provide such independent rotation; see FIG. 5 of said application. Such assemblies, however, necessitate a plurality of power sources or other drive components resulting in a multiplicity of parts which may be difficult to assemble or may increase operational problems.

OBJECTS OF THE INVENTION

Accordingly, it is an object of the present invention to provide an improved, low cost and simplified drive assembly for effectuating movement of a rotatable sweep arm around a grain bin independently of the direction of rotation of the arm.

It is another object of this invention to provide a drive assembly which is of simple design, is easy to install, and is efficient in operation.

It is still another object of this invention to provide a single, centrally-positioned power source to accomplish movement of the sweep arm around the bin and independent rotation thereof about its own axis.

Other objects, advantages and features of the invention will become apparent upon a reading of the following detailed description and appended claims, and upon reference to the accompanying drawings.

SUMMARY OF THE INVENTION

These objects are achieved by a drive assembly according to the invention which includes a sweep member suspended between a bin track along the inner wall of a storage bin and a pivotal support frame toward the center of the bin. The sweep member is adapted to carry at least one stirring member on a rotatable support portion of the sweep member. The stirring member depends downwardly from the support and is movable radially inwardly and outwardly along the support in response to the direction of rotation of the support about its own axis. A sweep drive unit extends over the bin track and is in a supporting relation with the outer end of the rotatable support, while being selectively independently rotatable thereof. A reversible drive assembly including oppositely oriented roller clutches is interconnected between the support and the sweep drive unit to effect unidirectional rotational drive of the sweep drive unit regardless of the direction of rotation of the support. Thus, the sweep member will move around the storage bin in a single direction as the support shaft is rotated and counter-rotated to move the stirring member inwardly and outwardly along the moving support.

DESCRIPTION OF THE DRAWINGS

For a complete understanding of this invention, reference should now be had to the embodiment illustrated in greater detail in the accompanying drawings and described below by way of an example of the invention, wherein.

While the invention will be described in connection with a preferred embodiment, it will be understood that it is not intended to limit the invention to that particular embodiment. On the contrary, it is intended to cover all alternatives, modifications and equivalents that may be included within the spirit and scope of the invention as defined by the appended claims.

DESCRIPTION OF THE PREFERRED EMBODIMENT

Figure 1:
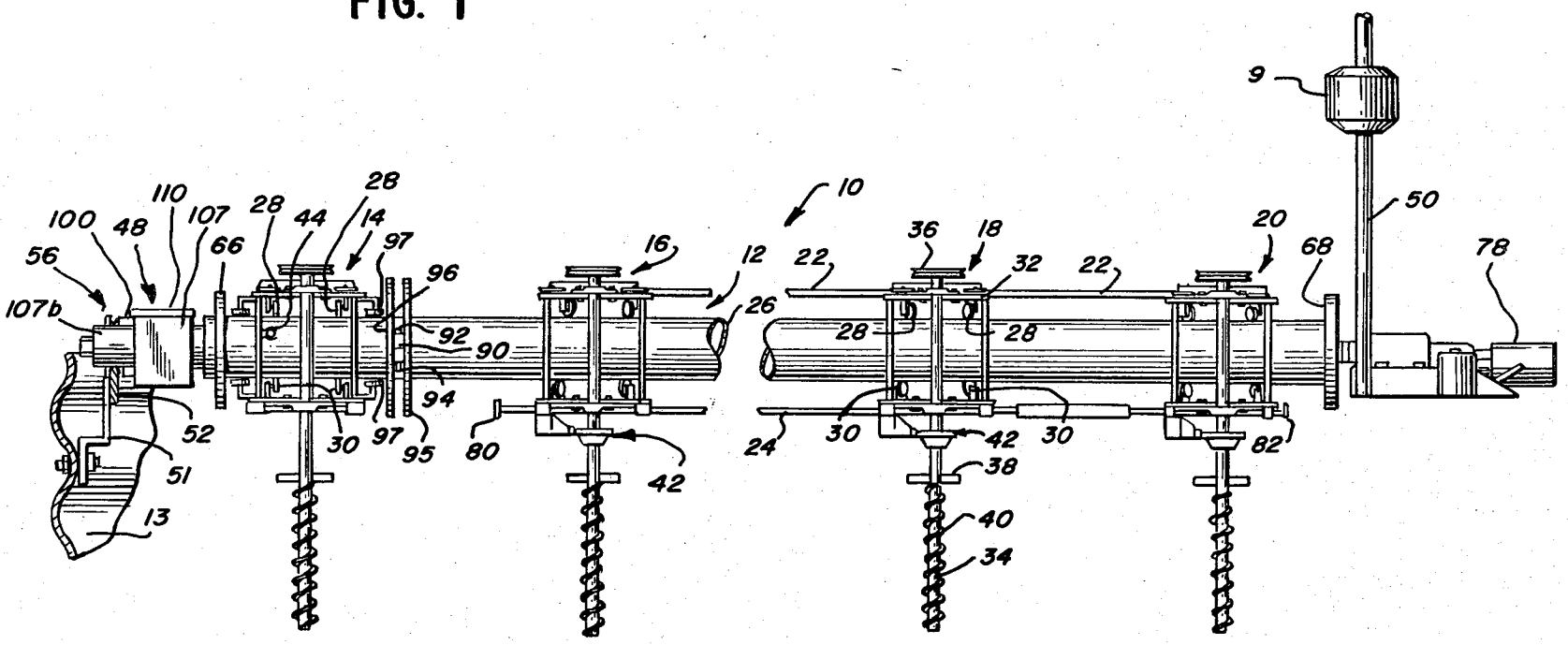
FIG. 1 is a side elevational view of a stirrer apparatus utilizing a drive arrangement embodying principles of this invention, shown suspended within a grain bin.

Turning now to the drawings, and principally FIG. 1, one embodiment of a grain stirring or moving apparatus is shown generally at 10 and described generally herein for purposes of illustrating this invention. Such stirrers are known, and are described in greater detail in the afore-mentioned application Ser. No. 877,951. The apparatus 10 includes a laterally extending sweep support or arm member 12, which normally extends radially of a bin 13 in which it is mounted, and stirring auger units 14, 16, 18, 20 which are supported on the sweep support member 12 and three of which 16, 18, 20 are adapted for radial movement along this support. The movable stirring units are linked together by rods 22. The rods maintain the augers 16, 18, 20 at predetermined spaced intervals and assure correlative movement of the stirring units along the sweep arm 12.

Figure 3:
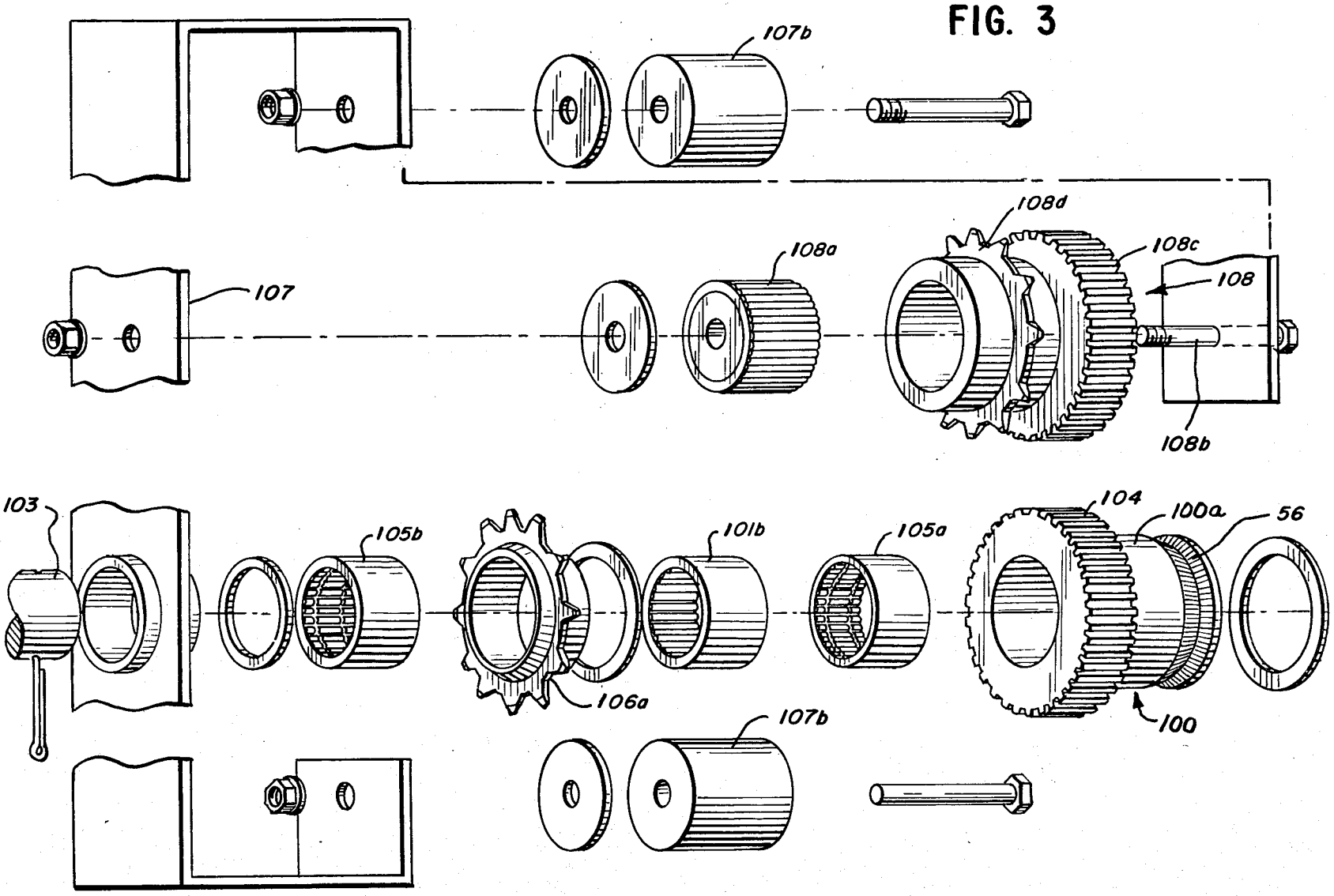
FIG. 3 is a perspective view of the component parts of the drive assembly shown in exploded relation.

Each stirring auger unit is supported on a support tube 26 of the sweep arm 12 by guide rollers 28, 30 which are attached to a stirring frame 32 of the auger unit. Guide rollers 28, 30 are canted on the movable units 16, 18, 20, relative to the axis of the laterally extending tube 26, to facilitate movement of each stirring unit 16, 18, 20 along the tube 26, as further described hereinafter. Each stirring unit includes an auger shaft 34 with flighting 40 which extends downwardly through openings in frame 32 and into grain therebelow (not shown). A V-pulley 36 is affixed to the upper end of each shaft 34 and is adapted to be engaged by a belt which is driven by an auger motor (not shown), mounted as shown in FIG. 3 of U.S. Pat. No. Re. 27,931 and attached to frame 32 on the trailing side of the sweep arm 12. A clearing blade 38 is secured to shaft 34 above shaft flighting 40 to keep grain from being drawn up and into the auger motor by flights 40, as the stirring auger is operated.

A centrifugal action electrical safety switch 42 is provided along the auger shaft 34 of each radially movable stirring unit to stop the respective drive motor if an inordinate amount of resistance is encountered by a shaft 34, or if the belt through a V-pulley 36 breaks which would result in stopping auger shaft rotation. Mounted on the unit 14 is a tilt-detecting cut-off switch 44 which will stop the forward movement of the sweep arm 12 if the auger 34 of unit 14 lags significantly behind the sweep arm 12, until the auger 34 returns to a substantially vertical position. The tilt switch may be a mercury tube of a known type. Such a tilt switch also may be utilized on each movable stirrer in place of the respective centrifugal switch.

The sweep arm member 12 includes the hollow cylindrical support tube or sleeve 26 and a drive assembly 48. The sweep arm 12 is suspended between a pivotal central frame 50 and a bin track 52. The bin track 52 is circular and is mounted along the upper inner periphery of the bin wall 13 via brackets 51. The central frame 50 is suspended from the bin roof (not shown) and is adapted for pivotal movement at bushing 9, about the bin center.

The drive assembly 48 extends beyond sleeve 26 and over bin track 52. A drive wheel 56 is adapted to ride between its two extending flanges 58, 60 (see FIG. 2) on bin track 52 and may be formed with serrations 61 for traction engagement with the track. When rotated, drive wheel 56 will move along bin track 52 and cause sweep arm 12 to traverse the bin circumferentially, pivoting about the bin center.

The support 26 is provided with a stop disc 66 on one end and a stop disc 68 on the opposite end. A split plate or collar 90 is clamped around the outer sleeve 26 at a position adjacent the outermost auger unit 14, by securing two semicircular halves thereof together with bolts 92, 94. The split plate provides a smooth surface on each side 95, 96 thereof. Upstanding disc 68 and split plate 90 limit the extent of stirring auger movement along sweep arm 12. Discs 66, 68 are either welded or secured by screws 70 to support 26.

A reversible gear motor 78 is mounted on frame 50 and directly connected to the support tube 26 for selective rotating and counterrotating drive of the support. Because motor 78 is secured on pivotal central frame 50, as the sweep arm 12 moves around the bin the relation between the motor 78 and sleeve 26 will remain the same. When the drive motor 78 is activated, it will cause support 26 selectively to rotate and counterrotate about its longitudinal axis. The drive motor may be mounted in other manners, such as being offset from the tube 26 and drive-connected thereto through a sprocket in the position of plate 68 as shown in the afore-mentioned Sukup application.

The outwardly facing surface of support tube 26 is substantially circular and smooth, providing an unobstructed surface over which guide rollers 28, 30, may roll. Because the guide rollers on auger units 16, 18 and 20 are canted, relative to the direction of support rotation, the units will traverse the sweep arm 12 when the outer sleeve is rotated. The distance traveled by stirring augers 16, 18, 20 along the sweep arm 12 during each rotation of support 26 will be directly related to the angle of the cant of guide rollers 28, 30, relative to the axis of the tube 26. If the direction of the rotation is reversed, a corresponding reversal of stirring auger movement along the sweep arm 12 will result. Auger unit 14 will not move along sweep arm 12, because its guide rollers are not canted.

A switch rod 24 extends between stirring augers 16, 18, 20 on the underside of frame 32 and is adapted for limited axial sliding movement. As the auger units approach either split plate 90 or disc 68 on opposite ends of the outer tube 26, a knob 80 or 82 secured to each end of rod 24 will abut against the upstanding face of the corresponding disc 68 or split plate 90. As the auger units continue to move axially, the rod 24 is displaced relative to the auger units, tripping a reversing switch on one frame 32 and causing reversal of the motor 78. The motor reversal effectuates support rotation reversal, and thereby causes the stirring auger units to begin moving toward the opposite end of the sweep auger 12.

It will be appreciated that other types of rotatable supports may be utilized, e.g., with flighting substantially as shown in U.S. Pat. No. 3,272,480. Also, while one selection of stirring augers has been illustrated, with one in a fixed position on the support, other arrangements are contemplated. The invention is applicable in stirrers wherein there is at least one stirrer to be moved along the rotatable support, including an installation with a single movable stirring unit and without the outer fixed unit 14. Whenever the outer fixed unit is omitted, the movable stirrer or stirrers would be permitted to move back and forth between the discs 66 and 68.

Figure 2:
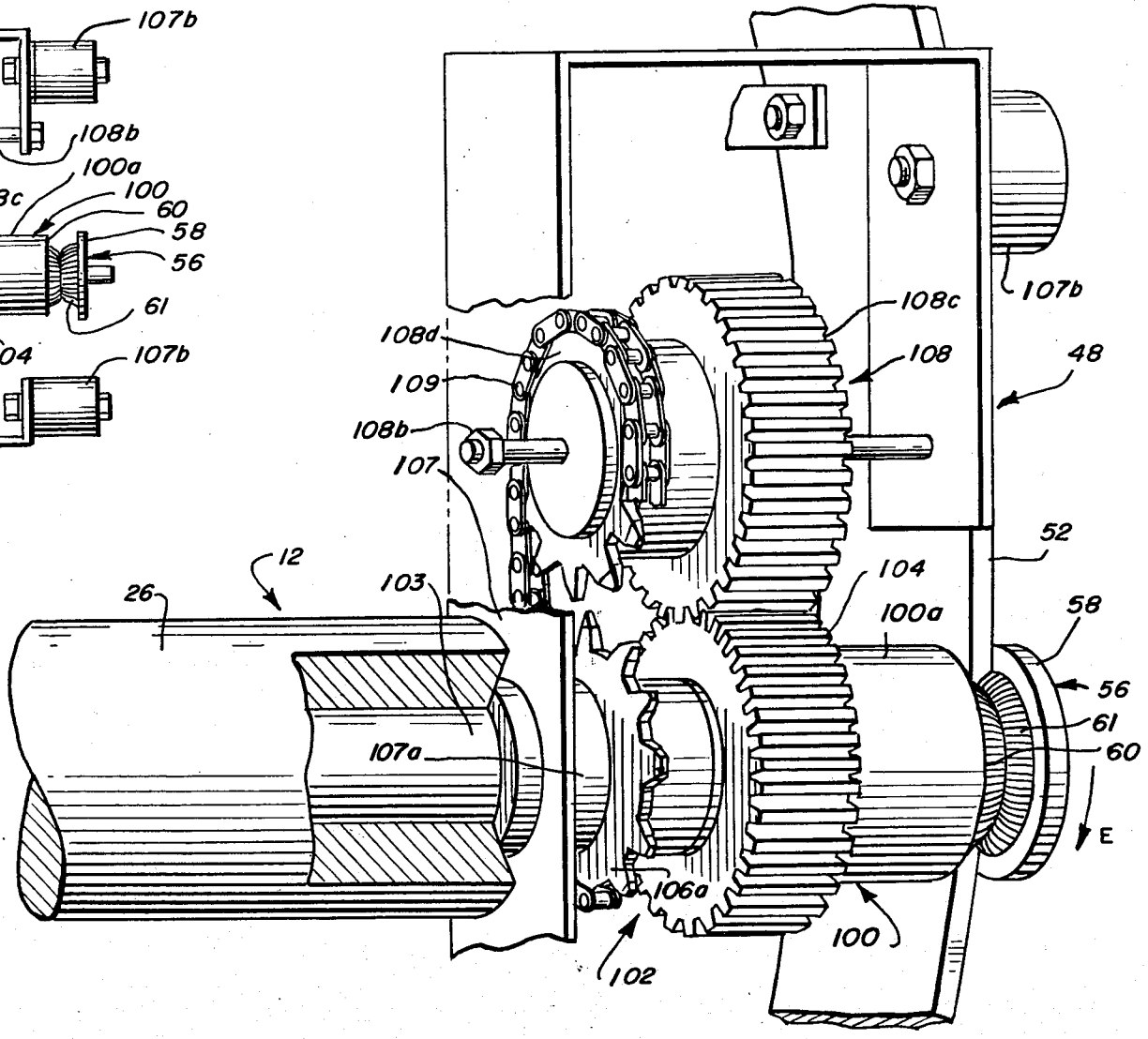
FIG. 2 is a perspective view of the reversing drive assembly of the apparatus of claim 1.

FIGS. 2 and 3 illustrate the reversing drive assembly 48 at the outer end of the sweep arm 12 in accordance with this invention. The sweep arm 12 includes the tubular support shaft 26 extending from the center support 50, and a drive unit 100 which extends over and rests on the bin track 52, to support the sweep arm 12 within the grain bin. The drive wheel 56 is an integral part of the unit 100 and engages the track. The drive unit is coaxial with the support shaft 26 and is independently rotatable. The reversible drive motor 78 drives the support member 26 as noted above, and an automatic selective reverse drive assembly 102 is coupled between the member 26 and the drive unit 100. The reversing drive effects unidirectional rotation of the drive unit 100 in response to the rotation of the member 26, regardless of the direction of rotation of the latter. Thus, the sweep arm is continuously advanced in one direction by the reversing drive from the rotation of member 26 as the latter is rotated alternately in opposite directions for positioning the movable stirring units therealong.

The drive unit 100 and reversing drive 102 are mounted on a reduced diameter shaft portion 103 which is fixed to and extends coaxially from the support member 26. The drive unit 100 includes the drive wheel 56 and a short sleeve section 100*a* with a spur gear 104 fixed thereon. A roller-type one way clutch bearing 105*a* and a support bearing 101*b* are fixed in the center bore of the drive unit and engage over the shaft 103. A second roller type one way clutch bearing 105*b* is fixed in sprocket 106*a* and is engaged over shaft 103 in an orientation opposite the clutch 105*a*. That is, clutches 105*a* and 105*b* are free-running in opposite directions of relative rotation of shaft 103. Each clutch will lock to the shaft to transmit torque from the shaft to the element in which the respective clutch is mounted upon attempted relative rotation between the shaft and the respective clutch in a reverse direction.

Figure 4:
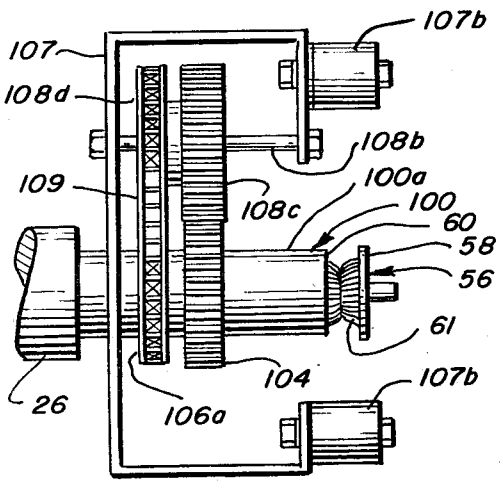
FIG. 4 is a top plan view of the reversing drive assembly.

A support bracket 107 is attached to a sleeve 107*a* through which shaft 103 freely passes. A roller 107*b* is secured to each opposite end of bracket 107 and overlies track 52 to stabilize the bracket, see also FIG. 4. A unified sprocket and gear unit 108 is supported on a bearing 108*a* mounted on bracket 107 by a bolt 108*b*. The gear 108*c* engages the gear 104. Sprocket 108*d* is aligned with sprocket 106*a* and is in drive relation therewith through a roller chain 109. Appropriate bearing washers are interposed between the components generally as illustrated.

As the support shaft 26-103 is rotated in one direction by the motor 78, i.e., clockwise in FIG. 2, the clutch 105*a* will frictionally grip the shaft 103 and thereby drive the unit 100 in the same direction. The engagement of the wheel 56 on the track 52 causes the sweep arm 12 to advance clockwise about the bin as indicated by the arrow E in FIG. 2. The reverse drive components 104, 108, 109, 106*a* will result in rotation of the sprocket 106*a* in the opposite direction. This relative counterrotation between the shaft 103 and the sprocket 106*a* is the direction of idling rotation of the clutch 105*b*, and thereby is accommodated. When the shaft 26-103 is rotated in an opposite direction by the motor 78, i.e., counterclockwise, the clutch 105*b* frictionally grips the shaft 103 and drives the sprocket 106*a* therewith in the same counterclockwise movement. The reversing drive components 106*a*, 109, 108, 104 thereupon drive the gear 104 and hence the unit 100 in a clockwise direction. Thus, the engagement of the wheel 56 on the track 52 continues to drive the sweep arm 12 in the clockwise direction E despite the reversal of the shaft 26-103. The corresponding counter-rotation occuring between the shaft portion 103 and the unit 100 is the direction of idling rotation of clutch 105*a* and thereby is accommodated.

Thus, it will be seen that with the reversing drive of FIGS. 2 and 3, a single reversible drive motor connected to the member 26, such as at 78, will effect both the reversing rotational movement of the support member of sweep arm 12 and the continuous unidirectional rotation of sweep drive wheel 56 throughout those reversals of the member 16. Thereby the sweep arm 12 is continuously advanced in one direction as the movable stirring units are moved inward and outward therealong, while maintaining the basic simple single axis rotatable support and movement system.

A removable cover 110 (FIG. 1) preferably is provided over the bracket 107 and related drive mechanism 48 to exclude falling grain and similar material therefrom.

The embodiment of FIGS. 2 and 3 is illustrated arranged for clockwise movement of the sweep in the bin. Of course, the components equally can be reversed for counterclockwise movement.

The out-and-in motion of the stirring augers along the sweep arm continues as the sweep arm revolves around the bin providing overlapping or contiguous foliate stirring paths. As such, substantially complete stirring of the grain is achieved. A variety of stirring auger path patterns may be generated to meet the requirement of a particular application, without departing from the scope of this disclosure. As also indicated above, such stirring may be obtained with more or less augers, dependent upon the size of the bin, the frequency of stirring desired and the relative rates of rotation.

If the outermost fixed auger unit 14 is used, it will repeatedly follow its same circular path during each revolution of the sweep arm, thereby stirring the grain adjacent the bin wall more frequently.

Thus, a drive arrangement and grain-moving apparatus are provided which meet the aforestated objects.

It will be appreciated that other specific arrangements of directional reversing drives may be utilized between the support arm and the drive wheel, such as various gear and/or sprocket combinations.

Thus, while particular embodiments of the invention have been shown or described, it will be understood that the invention is not limited thereto since further modifications may be made and other embodiments of the principles of this invention envisioned upon considering the foregoing teachings. It is therefore contemplated by the appended claims to cover any such modifications and other embodiments as incorporate those features which constitute the essential features of this invention within the spirit and scope of the following claims.

What is claimed is:

1. In apparatus for moving grain within a storage bin comprising a laterally extending sweep member suspended at an inner end portion by a pivotal support means and at an outer end portion by a track means secured to the storage bin; said sweep member including a sweep drive element in supporting and drive-engaging relation with said track means, and an auger support and movement element rotatable directionally independently of said drive element; at least one stirring member movably carried on said auger support and movement element and depending therefrom; and means for moving said stirring member inwardly and outwardly along said auger support and movement element in accordance with the direction of rotation of said auger support and movement element; the improvement comprising drive means connected to said support and movement element for selectively effecting rotation and counterrotation thereof, and selective reversible drive means connected for unidirectional rotation drive of said sweep drive element in response to such rotation and counterrotation of said support and movement element whereby said drive element propels the outer end of said sweep member along said track means in one direction while said selective rotation of said auger support and movement element causes selective movement of said stirring member inwardly and outwardly along said sweep member.

2. The apparatus as in claim 1 wherein said sweep drive element is rotatably and supportably mounted on an outer end portion of said support and movement element and said selective reversible drive means is disposed at the outer end portion of said sweep member.

3. Apparatus as in claim 1 or 2 wherein said selective reversible drive means comprises a pair of one-way clutches disposed for one to be driven and the other to rotate freely during each such rotation and counterrotation of said support and movement element, and means connecting each of said clutches to said drive element for rotation of said drive element in one direction by the respective clutch when such clutch is driven by said support and movement element.

4. The apparatus as in claim 3 including a support shaft extending from said support and movement element; a first rotary drive element disposed on said shaft; one of said one-way clutches being adapted for engaging said shaft and driving said first element therewith when said shaft is rotated in a first direction; said sweep drive element including a second rotary drive element and being rotatably mounted on said shaft; the other of said clutches being adapted for engaging said shaft and driving said sweep drive element and said second rotary drive element therewith when said shaft is rotated in a second direction; and drive transfer means interconnecting said first and second rotary drive elements for driving each from the other in opposite directions of rotation.

5. Apparatus as in claim 4 wherein one of said rotary drive elements is a first gear and the other is a first sprocket, said drive transfer means comprising an interconnected gear meshing with said first gear and sprocket aligned with said first sprocket, and a flexible chain drive between said sprockets.

6. Apparatus as in claim 1 wherein said drive mechanism is mounted on said pivotal support means in a predetermined relation to said sweep member.

7. Apparatus as in claim 1 including a plurality of such movable stirring augers distributed along and supported on said auger support and movement element.

8. Apparatus as in claim 1 including a support shaft at the outer end of said support and movement element, a first gear on said shaft and secured to said drive element, a roller clutch bearing on said shaft and secured to said drive element and said gear, whereby said drive element will rotate with said support shaft when said shaft is rotated in a first direction and is independently rotatable thereof when said support shaft is rotated in an opposite direction, a first sprocket, a second roller clutch bearing secured to said sprocket and mounted on said support shaft, whereby said sprocket is rotatable independently of said support shaft when said shaft is rotated in said first direction and rotates with said support shaft when said shaft is rotated in said opposite direction, a second gear in intermeshing relation with said first gear, a second sprocket secured to said second gear, and a chain in drive relation with said first and second sprockets whereby when said support shaft is rotating in said opposite direction said drive element will be rotated in said first direction, whereby said drive member is advanced in one direction regardless of the direction of rotation of said support and movement element.

* * * * *

UNITED STATES PATENT AND TRADEMARK OFFICE

CERTIFICATE OF CORRECTION

PATENT NO. : 4,274,750

DATED : June 23, 1981

INVENTOR(S) : Edward H. Smit

It is certified that error appears in the above-identified patent and that said Letters Patent are hereby corrected as shown below:

Column 5, line 60, "member 16" should read --member 26--.

Signed and Sealed this

*Eighth* Day of *September 1981*

[SEAL]

*Attest:*

GERALD J. MOSSINGHOFF

*Attesting Officer*

*Commissioner of Patents and Trademarks*